United States Patent [19]

Brewer

[11] Patent Number: 4,717,148

[45] Date of Patent: Jan. 5, 1988

[54] THERAPEUTIC EXERCISE APPARATUS

[76] Inventor: Clifford E. Brewer, Lucky Stars, 10 Lagoon Rd., Lilliput, Poole, Dorset, BH14 8JT, England

[21] Appl. No.: 890,388

[22] Filed: Jul. 29, 1986

[30] Foreign Application Priority Data

Aug. 7, 1985 [GB] United Kingdom ..... 8519828

[51] Int. Cl.[4] ..... A61H 1/02

[52] U.S. Cl. ..... 272/145; 272/72; 272/73; 128/75

[58] Field of Search ..... 272/93, 144, 145, 134, 272/72, 131; 128/71–75

[56] References Cited

U.S. PATENT DOCUMENTS

| | | | |
|---|---|---|---|
| 1,953,424 | 4/1934 | Miller . | |
| 2,176,342 | 10/1939 | Hoppe . | |
| 2,209,034 | 7/1940 | Paul | 272/72 |
| 2,446,275 | 8/1948 | Glasin . | |
| 2,714,507 | 8/1955 | Goodrich | 272/72 |
| 2,932,038 | 4/1960 | Sprague . | |
| 2,938,572 | 5/1960 | Solloway . | |
| 2,973,961 | 3/1961 | Behrens | 272/30 |
| 3,081,085 | 3/1963 | De Girolamo . | |
| 3,152,802 | 10/1964 | Heisler et al. . | |
| 3,286,708 | 11/1966 | Gartner . | |
| 3,568,669 | 3/1971 | Stites . | |
| 4,114,613 | 9/1978 | Kuhn . | |
| 4,232,662 | 11/1980 | Barber | 272/144 X |
| 4,367,731 | 1/1983 | Barber | 128/71 |
| 4,372,551 | 2/1983 | Yurdin | 272/134 X |

FOREIGN PATENT DOCUMENTS

| | | | |
|---|---|---|---|
| 0131167 | 1/1985 | European Pat. Off. . | |
| 2854142 | 6/1980 | Fed. Rep. of Germany | 272/144 |
| 872089 | 7/1961 | United Kingdom . | |
| 1390536 | 4/1975 | United Kingdom . | |
| 2131305 | 6/1984 | United Kingdom . | |

*Primary Examiner*—Richard J. Apley
*Assistant Examiner*—J. Welsh
*Attorney, Agent, or Firm*—Roylance, Abrams, Berdo & Goodman

[57] ABSTRACT

Therapeutic exercise apparatus comprising a frame, a bed device which is pivotally mounted with respect to the frame and which is pivotable between an upwardly inclined position for enabling the person to get on and off the bed device and a downwardly inclined position for enabling the person to hang with their head lower than their feet, a saddle, and a rowing device which is mounted on the bed device and which is pivotable backwards and forwards by a person seated on the saddle to simulate a rowing action.

10 Claims, 9 Drawing Figures

THERAPEUTIC EXERCISE APPARATUS

This invention relates to therapeutic exercise apparatus.

There are in existence various types of exercise machines. Probably the best known of these exercise machines is the static bicycle, although static rowing machines are also in existence. The known machines are invariably pieces of apparatus for exercising one part only of the body and they do not provide the facility of offering a therapeutic function.

It is an aim of the present invention to provide therapeutic exercise apparatus which enables a user to obtain a therapeutic function from the apparatus and which also enables the user to obtain an exercise function from the apparatus.

Accordingly, this invention provides therapeutic exercise apparatus comprising a frame, a bed device which is pivotally mounted with respect to the frame and which is pivotable between an upwardly inclined position for enabling a person to get on and off the bed device and a downwardly inclined position for enabling the person to hang with their head lower than their feet, a saddle mounted on the bed device, and rowing means comprising an elongate body having a first end portion which is pivotally connected to the bed device and a second end portion which is provided with a hand grip arrangement so that a person seated on the saddle can simulate a rowing action by gripping the hand grip arrangement and pivotting the elongate body backwards and forwards with respect to the bed device and which is pivotable backwards and forwards by a person.

The therapeutic exercise apparatus may include foot pedal means mounted on the bed device.

Preferably, the foot pedal means is releasably mounted on the bed device. The foot pedal means is advantageously releasably mounted on the bed device by means of a quick fixing which avoids the need to employ tools.

The therapeutic exercise apparatus may include hand pedal means mounted on the bed device.

Preferably, the hand pedal means is releasably mounted indirectly on the bed device by being releasably mounted on the rowing means. The hand pedal means is advantageously releasably mounted with a quick fixing which avoids the need to employ special tools.

Preferably, the frame is collapsible. The frame is advantageously collapsible by being foldable. However, as an alternative to being foldable, the frame may be collapsible by being telescopic.

With a collapsible frame, the therapeutic exercise apparatus can advantageously be stored away after use. Also, if the therapeutic exercise apparatus is collapsible, it can easily be transported, for example from place to place in a house, or by a person going on holiday so that a continuing exercise and therapeutic programme can be maintained.

Advantageously, the frame is A-shaped in side view with the bed device being pivotable about the apex of the frame. The A-shaped frame is relatively simple to produce and is also stable in use.

The bed device may be such that it has a first portion for supporting the person's body from their head substantially to the back of their thighs, and a second portion for mounting the saddle and the rowing means. The second portion may also mount the foot pedal means and the hand pedal means when they are present.

The first portion of the bed device may comprise a bed frame and a cover mounted on the frame.

The second portion of the bed device may extend beyond one end of the first portion of the bed device.

The saddle preferably has a saddle pillar which is of square cross section and which is mounted in a socket anchorage which upstands from the bed device and which is also of square cross section. With such an arrangement, the saddle cannot be rotated with respect to the socket anchorage and this is preferred.

The saddle may be such that it is provided with appropriate means for enabling it to be raised or lowered in height with respect to the socket anchorage. Thus, the saddle pillar may be associated with a pinch-bolt locking arrangement, or with an arrangement of a pin locating in one of a series of apertures. Advantageously, the saddle is mountable and dis-mountable from its socket anchorage and is also adjustable in height, all without the need for tools such as spanners.

Preferably, the rowing means is adjustably mounted on the second portion of the bed device.

The rowing means may be located on a slidable member which is able to slide up and down the second portion of the bed device, the sliding member being provided with locating means for locating in one of a series of apertures in the second portion of the bed device for retaining the sliding member in the required position. Usually, the adjustment will be effected in accordance with the height of the body and the desire to give good balance. The locating means may be a locating pin.

The hand pedal means may comprise a pair of hand grips. The hand grips may be used such that they are 180° displaced from each other so that the hand pedalling can be effected with the arms moving alternately. In another mode of use, the hand grips may be used such that they are level with each other so that the hand pedalling can be effected with the arms moving together.

The bed device may be provided with any desired appropriate padding.

The first and second portions of the bed device may be held together by a quick release locking device. The quick release locking device may be, for example, a quick release spring biased locking bolt. If the quick release locking device is released, then the bed device may fold for storage and transportation.

Preferably, the bed device has a pair of ankle supports and the rowing means has a pair of instep supports, the rowing means being such that it is able to be inclined towards a person lying on the bed device so as to trap the person's feet. The weight and the length of the rowing means is advantageously arranged to be such that the rowing means traps the person's feet between the pair of ankle supports and the pair of instep supports solely by gravitational forces, and no extra fixing means are required.

The bed device is preferably so balanced that a person lying on the bed device with their feet higher than their head can lie at various desired different angles of inclination solely by moving parts of their body such for example as their arms or bending their legs to cause the bed device to come to rest at a position of equalibrium which gives the desired angle of inclination.

The bed device may be provided with a pillow for supporting the person's back or their neck. Advantageously, the pillow is so mounted that it can slide along the bed device. The pillow may be a foam rubber pillow or it may be an inflatable pillow.

The therapeutic exercise apparatus may include a friction adjusting device for the foot pedal means. Thus, the friction adjusting device may be used to make it easier or harder to pedal with the foot pedal means, thus controlling the amount of exertion required. Similarly, the therapeutic exercise apparatus may include a friction adjusting device for the hand pedal means. Also, if desired, the therapeutic exercise apparatus may include a friction adjusting device for the rowing means.

Advantageously, the therapeutic exercise apparatus includes distance measuring apparatus for the foot pedal means and/or the hand pedal means and/or the rowing means.

The therapeutic exercise apparatus may also include speed measuring means for the foot pedal means and/or the hand pedal means and/or the rowing means.

The distance measuring apparatus and the speed measuring apparatus can advantageously be formed as a single device. Such devices are of course known in vehicles and they are also currently in use on some known static exercise cycles.

It will be apparaent that the therapeutic exercise apparatus is very useful in that it enables a person to indulge in pure exercise, or to indulge in pure therapy, or to indulge in a mixture of exercise and therapy. Thus, more specifically the foot pedal means when present can be used by the person to effect a cycling action to exercise the legs, the hand pedal means when present can be used to exercise the hands, wrists, arms and shoulders, and the rowing machine can be used to exercise the hands, arms and shoulders. The degree of exercise can be varied as required by the person doing the exercises and the general exercise will be good for the person's cardiovascular system. In addition, the person can hang in an inverted position with their head lower than their feet on the bed device. In this position, the pressure is removed from the person's spine so that the spine can be allowed to stretch and this may be effective to remove or reduce back pain. In addition, the blood can be allowed to flow towards the head which is good for circulation purposes and which may be effective to relieve headaches, especially those caused by tension.

Advantageously, parts of the therapeutic exercise apparatus are removable for ease of storage and use of the therapeutic exercise apparatus. Thus, for example, as mentioned above the foot pedal means, the hand pedal means and the rowing means may be arranged to be removable. The release of the parts of the therapeutic exercise apparatus is preferably by way of the above mentioned quick release devices so that the use of tools or the like is not required.

The therapeutic exercise apparatus may be made in any desired materials. Usually, the frame will be made of tubular metal such for example as steel. The steel may be chromium plated in order to give a good aesthetic look to the apparatus.

Embodiments of the invention will now be described solely by way of example and with reference to the accompanying drawings in which.

Figure 1:
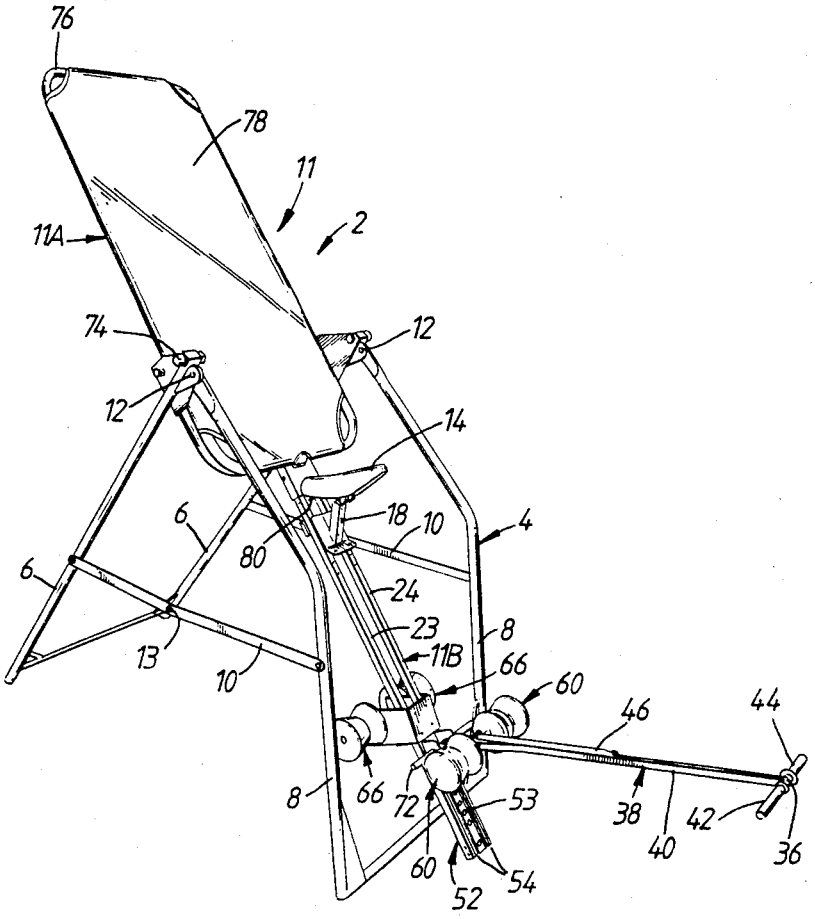
FIG. 1 is a perspective view from the front and one side of therapeutic exercise apparatus.
Figure 9:
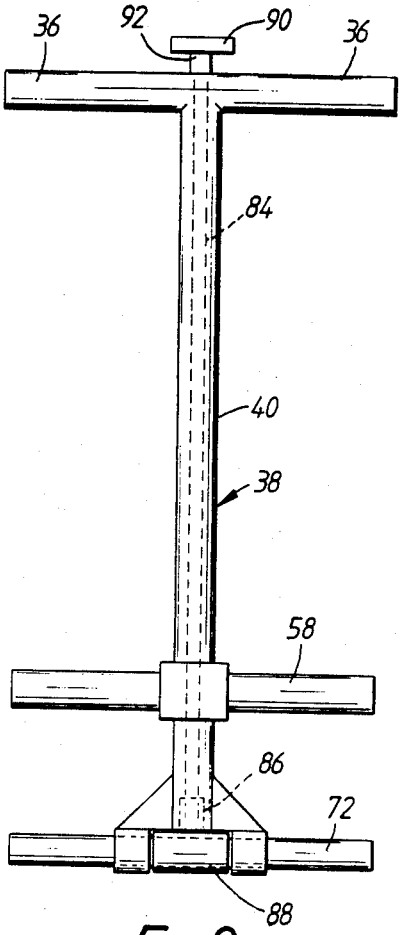

FIG. 9 showes a preferred modification for the therapeutic exercise apparatus shown in FIG. 1, the modification being in the form of friction adjustor means for the rowing means.

Referring to FIGS. 1 to 8, there is shown therapeutic exercise apparatus 2, comprising a frame 4. As can be seen from FIGS. 1 and 2, the frame 4 has a pair of rear legs 6, a pair of front legs 8 and a pair of collapsible cross braces 10. The legs 6, 8 pivot together about a pivot 12. In side view, the frame is A-shaped and the pivot 12 is at the apex of the A-shape. The cross braces are each in two parts as shown and the two parts pivot together to enable the cross braces 10 to fold by means of a pivot 13. Thus, the frame 4 can be collapsible from the operative position shown in FIGS. 1 and 2 to the folded position shown in FIG. 8. The relative position of the legs 6, 8 in the unfolded and in the folded positions of the frame 4 can be seen by comparing FIGS. 1 and 8.

The apparatus 2 includes a bed device 11 which comprises a first portion 11A for supporting a person's body 9 from their head substantially to the back of their thighs. The bed device 11 also comprises a second portion 11B which is in the form of an elongate member which is as shown and which extends beyond one end of the first portion 11A of the bed device 11. The second portion 11B has arms 23, 24.

The apparatus 2 comprises a saddle 14. The saddle 14 has a saddle pillar 16 which is of square cross section. The saddle pillar 16 fits into an anchorage socket 18 which upstands from the arms 23, 24. The anchorage socket 18 is also of square cross section so that when the saddle pillar 16 is in the anchorage socket 18, the saddle 14 cannot rotate.

The apparatus 2 is also provided with foot pedal means (see FIG. 6) in the form of a pair of foot pedals 20 which are mounted on cranks 22. The cranks 22 are pivotally mounted to the arms 23, 24 by means of a wing bolt 26.

Figure 4:
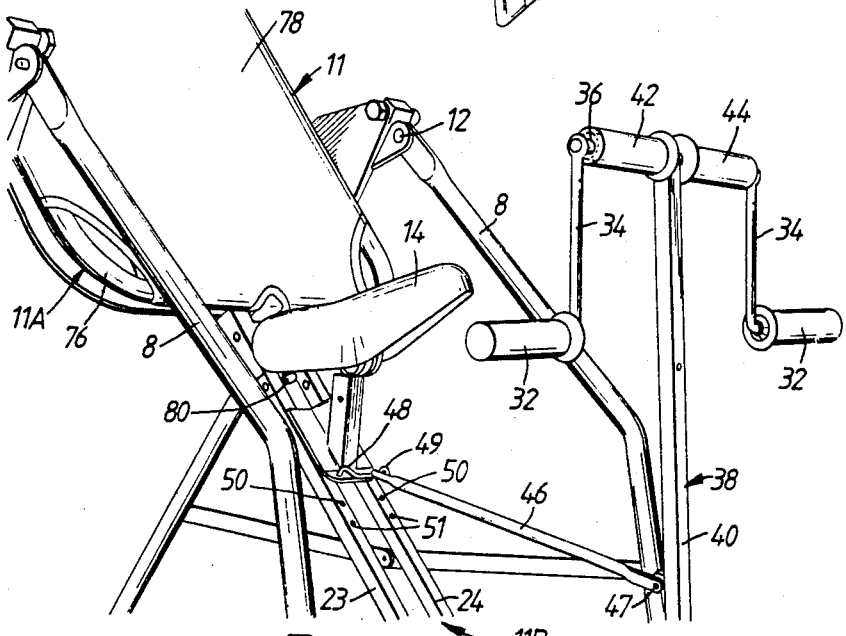
FIG. 4 is a detail of the saddle portion and the upper portion of the rowing machine of the therapeutic exercise apparatus.

The apparatus 2 further includes hand pedal means in the form of a pair of hand pedals 32, as shown in FIG. 4. The hand pedals 32 are mounted on cranks 34. The cranks 34 are mounted for rotation in a tube 36. If desired, the cranks 34 may rotate on bushes such for example as nylon bushes in order to facilitate the easy rotation of the cranks 34 in the tube 36.

The apparatus 2 further comprises rowing means 38. The rowing means 38 has a frame 40. The top part of the frame 40 is constituted by the tube 36. The tube 36 is provided with hand grips 42, 44 which slip over the outside ends of the tube 36 and which can be gripped by a person wishing to use the rowing means 38.

When the hand pedals 32 are to be used, a brace 46 is moved from its stored position as shown in FIG. 1 to its operative position as shown in FIG. 4. The brace 46 pivots about the frame 40 by means of a pivot 47. The other end of the brace 46 is provided with a pair of hooks 48, 49 which fit in desired pairs of holes 50, 51 formed in the arms 23, 24. By selecting an appropriate pair of holes 50 or 51, the angle of inclination of the rowing means can be varied.

The arms 23, 24 are provided at their bottom ends with an aperture device 52 which has a series of apertures 53 and which also has a pair of tracks 54. A sliding member 56 slides in these tracks 54. The sliding member 56 supports the frame 40 of the rowing means 38. The sliding member 56 also supports a tube 58 for receiving a pair of instep supports in the form of a pair of foam rubber spools 60. The foam rubber spools 60 may be covered with covers 62.

The sliding member 56 further supports a tube 64 for supporting a pair of ankle supports in the form of a pair of spools 66. The spools 66 may be made of foam rubber and they may be provided with washable covers if desired.

The sliding member 56 can slide up and down the tracks 54 until it is at a desired position. This sliding of the sliding member 56 up and down the tracks 54 is allowed by upwardly pulling locating means in the form of a pin 68. When the sliding member 56 is at a desired position along the tracks 54, the pin 68 may then be released whereupon a spring 70 pushes the pin 68 into an appropriate one of the apertures 53. The apertures 53 can advantageously be marked with the sizes of persons likely to use the apparatus 2 so that a person can locate the pin 68 in an aperture 53 appropriate to his or her height. The hand pedals 32 will then be at a correct height for hand pedalling, and the rowing means 38 will also then be at a correct height for rowing.

Figure 5:
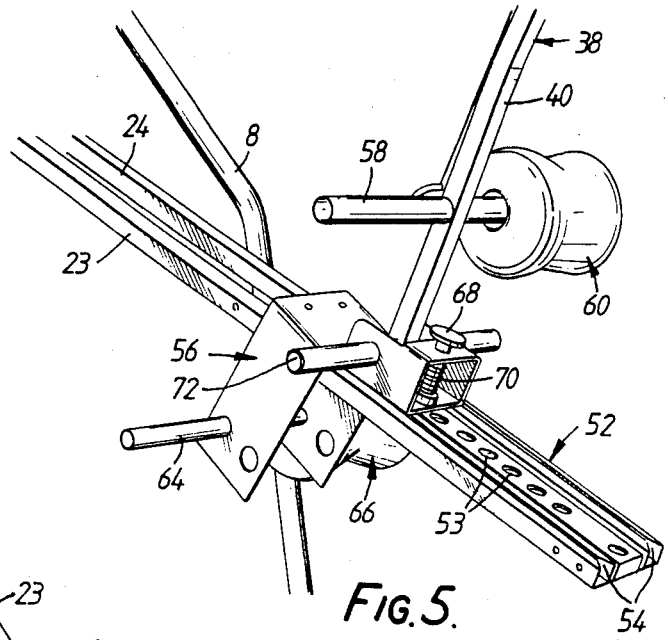
FIG. 5 is a detail from the front and one side of the foot rest portion of the therapeutic exercise apparatus.
Figure 6:
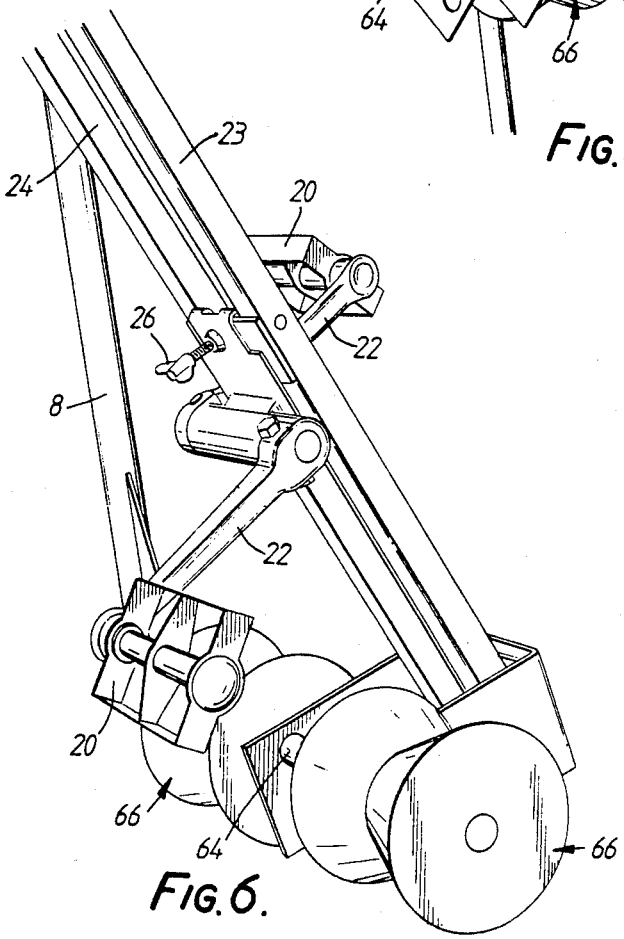
FIG. 6 is a detail from the rear of the foot rest portion shown in FIG. 5 and it shows also the foot pedal means mounted for rotation on a second portion of the bed device.
Figure 7:
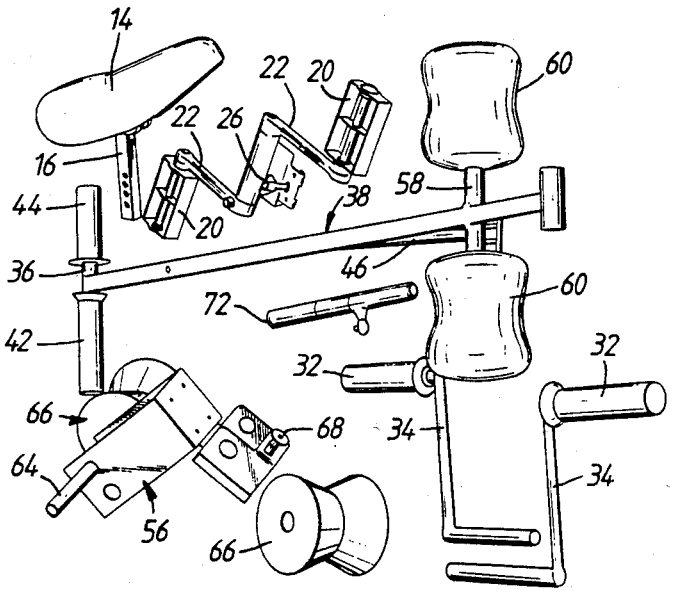
FIG. 7 shows various removable parts of the therapeutic exercise apparatus.
Figure 8:
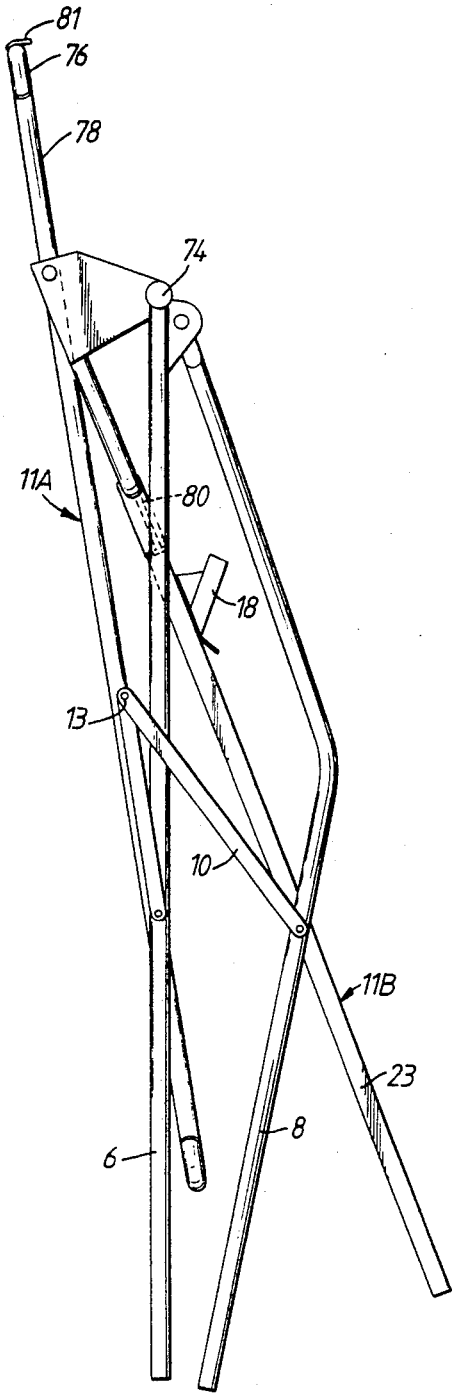
FIG. 8 shows the therapeutic exercise apparatus in a folded condition.

The sliding member 56 supports foot rest means in the form of a foot rest tube 72 as shown most clearly in FIG. 5.

Figure 2:
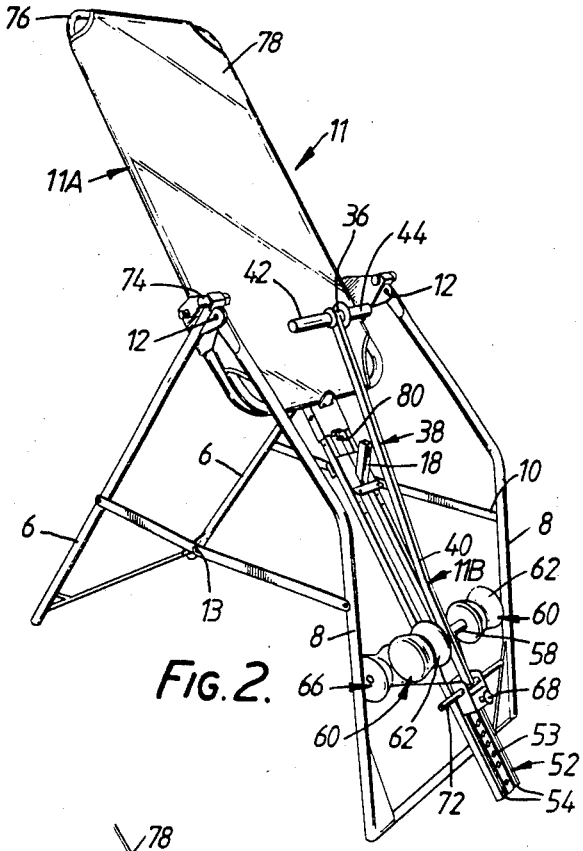
FIG. 2 is a perspective view which is the same as that shown in FIG. 1, except that the rowing means is shown in a different position.
Figure 3:
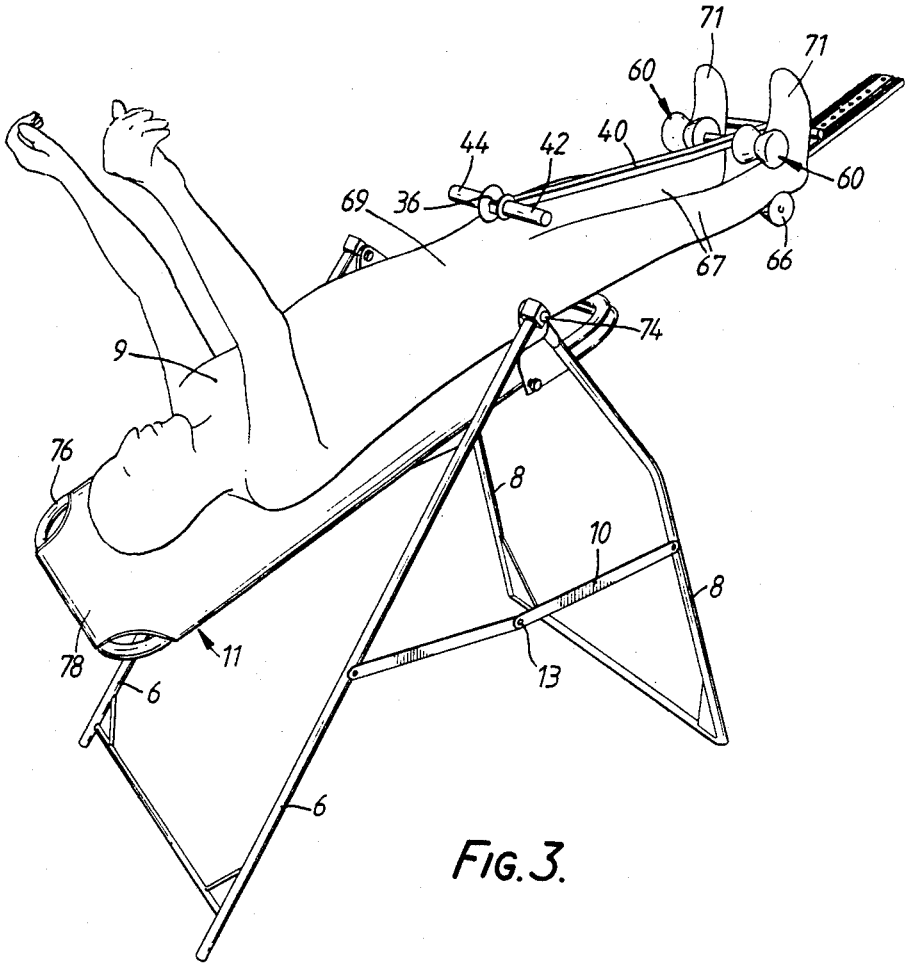
FIG. 3 is a perspective view from the rear and one side of the therapeutic exercise apparatus shown in FIG. 1 and it illustrates the use of the bed device for supporting a person with their head lower than their feet.

When the rowing means 38 and especially the frame 40 is moved from the open position shown in FIG. 1 to the closed position shown in FIG. 2, it will be apparent by reference to FIG. 3 that the spools 60 trap the person's instep and the spools 66 trap the person's ankle. It can be seen from FIG. 3 that the length of the frame 40 is such that it will rest under gravity aligned with the person's legs 67 and their abdomen 69, and the force of gravity will not allow the frame 40 to rise upwards. Thus, the person 9 lying in the position shown in FIG. 3 on the bed device 11 is quite safe and no extra locking means for holding the person's feet 71 are required.

The first portion 11A of the bed device 11 comprises a bed frame portion 76 which is covered by a canvass covering 78. The canvass covering 78 is held in position on the bed frame portion 76 by being tied on the side remote from the side on which the person 9 is lying.

The bed device 11 pivots freely about a pivot point 74 which is basically at the apex of the A-shaped frame constituted by the legs 6, 8. A person 9 lying on the bed device 11 as shown in FIG. 3 can vary their angle of inclination by moving their legs and or their arms. For example, if the person 9 raises their arms as shown in FIG. 3, then this will cause the weight of the body to pivot the bed device 11 to a steeper angle of inclination. The angle of inclination will be reduced if the person 9 folds their arms about their chest. A further reduction in the angle of inclination can be effected by the person raising their knees. By throwing the arms forward, the person can cause the bed device 11 to pivot from the position shown in FIG. 3 to the position shown in FIG. 1, whereupon the person 9 can dismount from the bed device 11.

The first and second portions 11A, 11B of the bed device 11 are held in their operative position as shown in FIG. 1 by means of a quick release bolt 80 in an aperture in a bracket 81. The quick release bolt 80 is spring biased to a locking position. When the bolt 80 is released, the first and second portions 11A, 11B of the bed device 11 can fold up to the position shown in FIG. 8. In the folded position, the apparatus 2 can easily be transported and stored.

For any use of the apparatus 2 in which various parts of the apparatus 2 are not required, these parts can easily be removed without the use of tools such for example spanners. Thus, it will be apparent from FIG. 7 that the saddle 14, the foot pedals 20, the hand pedals 32, the entire rowing means 38 and the foot rest tube 72 can be removed as and when desired.

Referring now to FIG. 9, there is shown the rowing means 38 with the tubes 36, 58, 72. The rowing means 38 has however been modified in that the frame 40, which is tubular, receives a long threaded member 84 which threads into a stub portion 86. The stub portion 86 extends from a short tube 88. The short tube 88 fits over the tube 72 so that it will be apparent that the tube 88 can bind on the tube 72 with more or less force depending upon whether or not the threaded member 84 is tightened or loosened. The threaded member 84 can be tightened or loosened by means of a handle 90. A collar 92 extends from the handle 90 and enables the handle 92 to rotate in the tube 36.

It will be appreciated from the above description with reference to the drawings that the therapeutic exercise apparatus 2 is a single piece of multi-purpose apparatus that can be used for the four function of foot cycling, hand cycling, rowing and hanging. These four functions enable a user to exercise various parts of the body and also to indulge in therapeutic hanging, for example for helping to relieve backache, other spinal problems or headaches. The therapeutic exercise apparatus 2 can very easily be folded so that it can be kept in a room such for example as a bedroom and stored in a cupboard or in a corner of the room when it is not required. The apparatus 2 is light in addition to being easily foldable, so that it can be taken on holiday so that a person need not interrupt their exercise/therapeutic programme.

It is to be appreciated that the embodiments of the invention described above with reference to the accompanying drawings have been given by way of example only and that modifications may be effected. Thus, for example, similar friction adjustor means to that illustrated in FIG. 9 may be employed for giving adjustment of the foot pedal means and also for giving adjustment of the hand pedal means. Also, if desired, a pillow may be provided on the bed device 11 for supporting a person's back or neck. Preferably, the pillow (not shown) is slidably mounted along the first portion 11B of the bed device 11 so that it can be slid to any desired position. The saddle will usually be adjustable in height by means of the illustrated apertures 90 in the saddle pillar 16 but it may be adjustable by means of a pinch-bolt arrangement if desired. The shape of the frame 4 may be varied if desired and, preferably, the frame 4 is provided with feet which are covered in a protective material such for example as rubber in order to minimise on any possible damage to floor coverings when the apparatus 2 is used in the home. The apparatus 2 may be modified so that the foot pedal means and the hand pedal means are omitted, the apparatus 2 then being sold with just the bed device and the rowing means.

I claim:

1. Therapeutic exercise apparatus, comprising: a frame, a bed device which is pivotally mounted with respect to the frame and which is pivotable between an upwardly inclined position for enabling a person to get on and off the bed device and a downwardly inclined position for enabling the person to hang with their head lower than their feet, a saddle mounted on the bed device, and rowing means comprising an elongate body having a first end portion which is pivotally connected to the bed device and a second end portion which is provided with a hand grip arrangement so that a person seated on the saddle can simulate a rowing action by gripping the hand grip arrangement and pivoting the elongate body backwards and forwards.

2. Therapeutic exercise apparatus according to claim 1 and including first pedal means which is mounted on the bed device and which is for being rotated by feet of the person when the person is seated on the saddle.

3. Therapeutic exercise apparatus according to claim 1 and including first pedal means which is mounted on the bed device and which is for being rotated by feet of the person when the person is seated on the saddle, and second pedal means which is mounted on the bed device and which is for being rotated by hands of the person when the person is seated on the saddle.

4. Therapeutic exercise apparatus according to claim 3 in which the frame is collapsible, in which the frame is A-shaped, and in which the bed device is freely pivotable about an apex part of the frame.

5. Therapeutic exercise apparatus according to claim 4 in which the bed device is such that it has a first portion for supporting the person's body from their head substantially to the back of their thighs, and a second portion for mounting the saddle, the first pedal means, the second pedal means and the rowing means.

6. Therapeutic exercise apparatus according to claim 5 in which the first portion of the bed device comprises a bed frame and a cover mounted on the frame, and in which the second portion of the bed device comprises an elongate member which extends beyond one end of the first portion of the bed device.

7. Therapeutic exercise apparatus according to claim 6 in which the saddle has a saddle pillar which is of a square cross section and which is mounted in a socket anchorage which upstands from the bed device and which is also of a square cross section.

8. Therapeutic exercise apparatus according to claim 5 in which the rowing means is located on a sliding member which is able to slide up and down the second portion of the bed device, the sliding member being provided with locating means for locating in one of a series of apertures in the second portion of the bed device for retaining the sliding member in the required position.

9. Therapeutic exercise apparatus according to claim 6 in which the bed device has a pair of ankle supports and the rowing means has a pair of instep supports, the rowing means being such that is is able to lie inclined towards the person lying on the bed device so as to trap the person's feet, and the weight and the length of the rowing means being such as to trap the person's feet solely by gravitational forces whereby no extra fixing means are required.

10. Therapeutic exercise apparatus according to claim 1 and including first pedal means which is mounted on the bed device and which is for being rotated by feet of the person when the person is seated on the saddle, second pedal means which is mounted on the bed device and which is for being rotated by hands of the person when the person is seated on the saddle, and a friction adjusting device for at least one of the first pedal means, the second pedal means, and the rowing means.

* * * * *